US010835005B2

(12) United States Patent
Buerck

(10) Patent No.: US 10,835,005 B2
(45) Date of Patent: Nov. 17, 2020

(54) ADJUSTABLE POUCH WITH LACE TIGHTENING MECHANISM HAVING ENCLOSED PROTECTED LACES

(71) Applicant: FirstSpear, LLC, Fenton, MO (US)

(72) Inventor: Trevor S. Buerck, Festus, MO (US)

(73) Assignee: FirstSpear Technology Group, LLC, Fenton, MO (US)

( * ) Notice: Subject to any disclaimer, the term of this patent is extended or adjusted under 35 U.S.C. 154(b) by 0 days.

(21) Appl. No.: 16/478,321

(22) PCT Filed: Jan. 17, 2018

(86) PCT No.: PCT/US2018/014119
§ 371 (c)(1),
(2) Date: Jul. 16, 2019

(87) PCT Pub. No.: WO2018/136568
PCT Pub. Date: Jul. 26, 2018

(65) Prior Publication Data

US 2019/0365064 A1 Dec. 5, 2019

Related U.S. Application Data

(60) Provisional application No. 62/447,408, filed on Jan. 17, 2017.

(51) Int. Cl.
*A45C 7/00* (2006.01)
*A45C 13/10* (2006.01)
(Continued)

(52) U.S. Cl.
CPC ..... *A45C 7/0059* (2013.01); *A45C 13/1046* (2013.01); *A45F 3/06* (2013.01);
(Continued)

(58) Field of Classification Search
CPC ..... F42B 39/02; F42B 39/26; A45C 13/1046; A45C 13/30; A45C 7/0063; A45C 7/0031;
(Continued)

(56) References Cited

U.S. PATENT DOCUMENTS 7,650,705 B2 * 1/2010 Donnadieu ..... A43B 5/0411 36/50.5
9,138,030 B2 9/2015 Soderberg et al.
(Continued)

OTHER PUBLICATIONS

"Condor Side Plate Utility Pouch" (LA Police Gear) May 18, 2014; retrieved from internet Mar. 15, 2018; <https://www.lapolicegear.com/tg-ma75-side-pouch.html>; entire document, especially Features.

(Continued)

*Primary Examiner* — Adam J Waggenspack
(74) *Attorney, Agent, or Firm* — Matthews Edwards LLC

(57) ABSTRACT

An adjustable pouch or pocket for carrying an article such as one or more ammunition magazines, armor plates, batteries, radios, grenades, bottles, and the like in hostile environments, integrates a lace tightening system for adjusting the pouch size, fit, and/or tightness about the article or articles, wherein a lace or laces of the tightening system are largely or substantially incorporated into an arrangement of one or more enclosed cavities or pockets within or between certain of the panels so as to be protected from exposure and potential damage while still allowing free movement of the lace or laces, and which largely isolates the laces from the carried article or articles so as not to catch or snag the article when being inserted or removed from the pouch.

24 Claims, 18 Drawing Sheets

(51) Int. Cl.

| | |
|---|---|
| ***A45F 3/06*** | (2006.01) |
| ***A45F 5/02*** | (2006.01) |
| ***F42B 39/02*** | (2006.01) |
| *A45F 3/00* | (2006.01) |

(52) U.S. Cl.
CPC ..... *A45F 5/02* (2013.01); *F42B 39/02* (2013.01); *A45F 2003/003* (2013.01)

(58) Field of Classification Search
CPC ..... A45C 7/0054; A45F 5/02; A45F 5/021; A45F 2200/0591; B65D 21/08
USPC ..... 190/103, 105
See application file for complete search history.

(56) References Cited

U.S. PATENT DOCUMENTS

| | | | | |
|---|---|---|---|---|
| 9,394,080 | B2 * | 7/2016 | Beck | F42B 39/26 |
| 9,480,437 | B2 | 8/2016 | Goodman et al. | |
| 9,759,536 | B2 * | 9/2017 | Gadams | B65D 25/20 |
| 9,861,184 | B2 * | 1/2018 | VanHeusen | F41C 33/0209 |
| 10,306,973 | B2 * | 6/2019 | Evans | A45F 5/021 |
| 10,352,652 | B2 * | 7/2019 | Higdon, Jr. | F41C 33/046 |
| 2004/0182859 | A1 * | 9/2004 | Pai | B65D 5/4283 220/9.4 |
| 2013/0269219 | A1 | 10/2013 | Burns et al. | |
| 2016/0003598 | A1 | 1/2016 | Gadams et al. | |
| 2016/0058127 | A1 * | 3/2016 | Burns | A45F 5/02 36/58.5 |
| 2016/0209163 | A1 | 7/2016 | VanHeusen | |

OTHER PUBLICATIONS

"AK Bungee-Cover Single" (5.11) Jun. 14, 2016; retrieved from internet Mar. 16, 2018; <https://web.archive.org/web/20160614174539/http://www.511tactical.com:80/ak-bungeecover-single.html>; entire document, especially Fig. 1; overview.

"FirstSpear MultiMag, Rapid-Adjust" (FirstSpear1) Jul. 7, 2017; retrieved from intrnet Mar. 15, 2018; <https://www.youtube.com/watch?v=DGwwh4ED1Ts>; entire document.

"First Look: First Spear MultiMag Rapid Adjust Pocket" (SKDTAC) Sep. 13, 2017; retrieved from internet Mar. 15, 2018; <https://www.youtube.com/watch?v=TK3Dwx51Nbo>; entire document.

* cited by examiner

ADJUSTABLE POUCH WITH LACE TIGHTENING MECHANISM HAVING ENCLOSED PROTECTED LACES

This application is submitted under 35 U.S.C. 371 claiming priority to PCT/US2018/14119, filed Jan. 17, 2018, which application claims the benefit of U.S. Provisional Application No. 62/447,408, filed Jan. 17, 2017.

TECHNICAL FIELD

This invention relates generally to a pouch or pocket for carrying an article such as one or more ammunition magazines, armor plates, batteries, radios, grenades, bottles, and the like in hostile environments, and more particularly that uses a lace tightening mechanism for adjusting the pouch size, fit, and/or tightness about the article or articles, that has a lace or laces largely or substantially incorporated into an arrangement of one or more enclosed cavities or pockets in or between panels of the arrangement so as to be protected from exposure and potential damage while still allowing free movement of the lace or laces, and which largely isolates the laces from the carried article or articles to avoid snagging and catching on the article when being inserted into or removed from the pouch.

BACKGROUND ART

U.S. Provisional Application No. 62/447,408, filed Jan. 17, 2017, is incorporated herein by reference in its entirety.

Various lacing systems utilizing are available for use in connection with carrying various articles, and suffer from various drawbacks. For example, some lacing systems include exposed laces, which can be damaged and/or unintentionally caught on objects such as branches, thorns, grass, etc., in hostile environments and actuated (e.g., loosened), resulting in problems, failures, etc. Reference in this regard, Burns et al., U.S. Patent Publication No. 2013/0269219, entitled Tightening Mechanisms and Applications Including the Same, hereby incorporated herein by reference in its entirety; and various lace tightening systems commercially available from the assignee of the underlying invention, Boa Technology Inc. of Denver Colo. USA. While these applications of the Boa lace tightening system adequately conceal and protect the tightening mechanism, the laces are largely routed so as to be exposed and subject to environmental elements and damage. Accordingly, there persists a need for lacing systems that include better protected laces.

Another drawback to be avoided for many applications would be a lace exposed to the interior of a pouch or pocket so as to potentially unintentionally catch on or entangle with an article as it is being inserted or removed to impede or prevent that action or unintentionally activate or deactivate the article. As an example, pockets for carrying ammunition or grenades should allow them to be quickly and smoothly deliberately withdrawn using sufficient manual force to overcome the tension of the lacing system, and the lacing system is desirably tensioned to prevent unintentional removal as a result of normal activities such as jumping or falling. As another example, it would be undesirable to unintentionally activate or deactivate a radio, beacon, flashlight, or the like while inserting it into or removing it from a pouch or pocket.

It is also sought for some applications to provide a pouch, pocket, or the like, that is adjustable in interior cavity dimension or size in at least one direction, so as to accommodate articles of different sizes or types, so that a smaller range of sizes and shapes of pouches or pockets can be utilized for holding a larger range articles.

Thus, what is sought is an adjustable pouch or pocket for securely carrying one or more articles that overcomes one or more of the shortcomings and limitations set forth above.

SUMMARY OF THE INVENTION

What is disclosed is an adjustable pouch or pocket for securely carrying one or more articles such an ammunition magazine, armor plate, battery, telephone, radio, grenade, bottle, first aid pack, weapon, and the like, suitable for use in hostile environments, and that overcomes one or more of the shortcomings and limitations set forth above.

As a preferred aspect of the invention, the pouch or pocket (herein sometimes collectively or interchangeably referred to using the term "pouch") utilizes a lace tightening mechanism such as, but not limited to, any of several commercially available from Boa Technology Inc. of Denver Colo. USA for adjusting the pouch size, fit, and/or tightness about the article or articles. This is achieved using a lace or laces, which can be polymer, metal, natural material, of monofilament or multifilament construction, having adequate strength for holding a desired article or articles within a pouch. As a representative but non-limiting example, the tightening mechanism can be constructed and operable in the manner described and illustrated in Burns et al., U.S. Patent Publication No. 2013/0269219, essentially manually operable by rotation of an external knob of a ratchet mechanism to rotate an internal spool or spools onto which the lace or laces is/are wound. The laces extend from the mechanism to form a loop which is routed in connection with panels forming the pouch such that as the lace or laces is/are drawn toward the tightening mechanism they are shortened to pull one of the panels toward an opposite panel, or the panels together, to reduce one or more dimensions of an interior cavity bound and defined by the panels. Here, it should be understood that by the terms "lace" or "laces", what is meant is the ends of a single or multiple piece long wire, string, filament, etc., or multiple ones, having two ends that attach to the tightening mechanism, or one end attached to the tightening mechanism and another attached to another location, e.g., fixed location, so that when the mechanism is operated to tighten, at least one of the ends is drawn toward the mechanism.

As another preferred aspect of the invention, the pouch or pocket is configured to protect or shield the laces from exposure to the environment, so that they are not damaged, or exposed so as to become caught or entangled with hazards such as vines, branches, wire, etc., and thereby restrict movement. This is particularly important for applications such as wherein the pouch is carried on a person's body, for instance, as part of the kit of a soldier, sailor, marine, law enforcement officer, etc., where freedom of movement is imperative and the wearer may be crawling through brush and or debris, or moving through underbrush, concealment netting, wire, fences, obstacles, etc. Also in this context of the invention, the surfaces of the panels comprising the pouch that bound and define the interior cavity of the pouch are preferably configured such that the laces are isolated or separated from the interior cavity so as not to catch on or entangle with an article to be held in the interior cavity so as to prevent its insertion and/or removal, and so that the laces will not interact with elements of an article, such as a switch, e.g., telephone, radio, so as to unintentionally activate or deactivate it. The panels are further preferably arranged so as to be relatively movable without binding or creasing, including when an article or articles are located in the interior cavity and the pouch is tightened or snugged about it/them.

As still another preferred aspect, the pouch or pockets of the invention are configured and operable to securely hold an article or articles, so as to prevent unintentional removal from the pouch, while still allowing rapid intentional manual removal in a predetermined manner, such as, but not limited to, using a single hand in a manual pulling action in a predetermined direction. This has been found to be useful in stressful situations such as during combat and particularly during emergency situations including when time is of the essence. As another preferred aspect the configuration of the pouches additionally allows removal of the article substantially silently.

DETAILED DESCRIPTION OF PREFERRED EMBODIMENTS OF THE INVENTION

Figure 1:
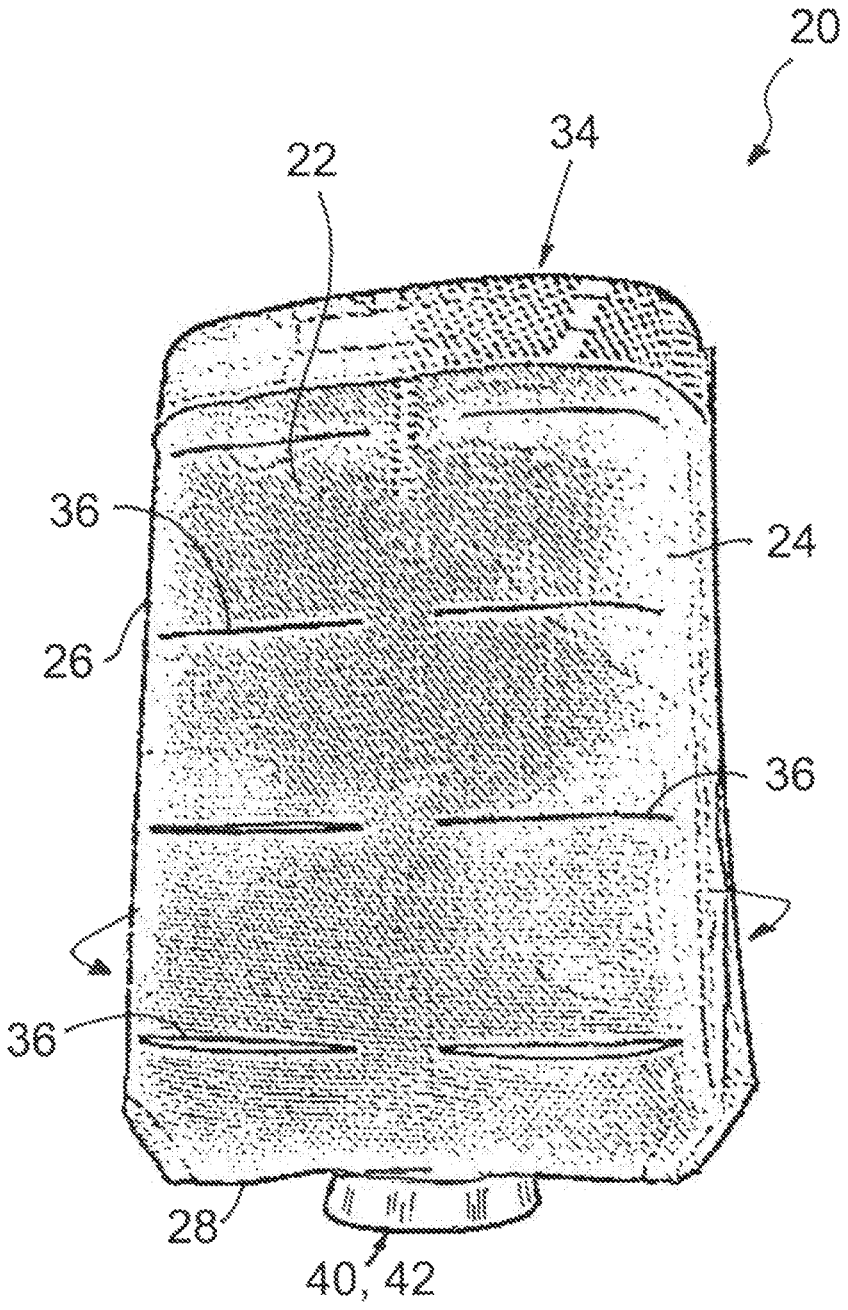
FIG. 1 is a front view of an embodiment of an adjustable pouch constructed and operable according to the invention.
Figure 2:
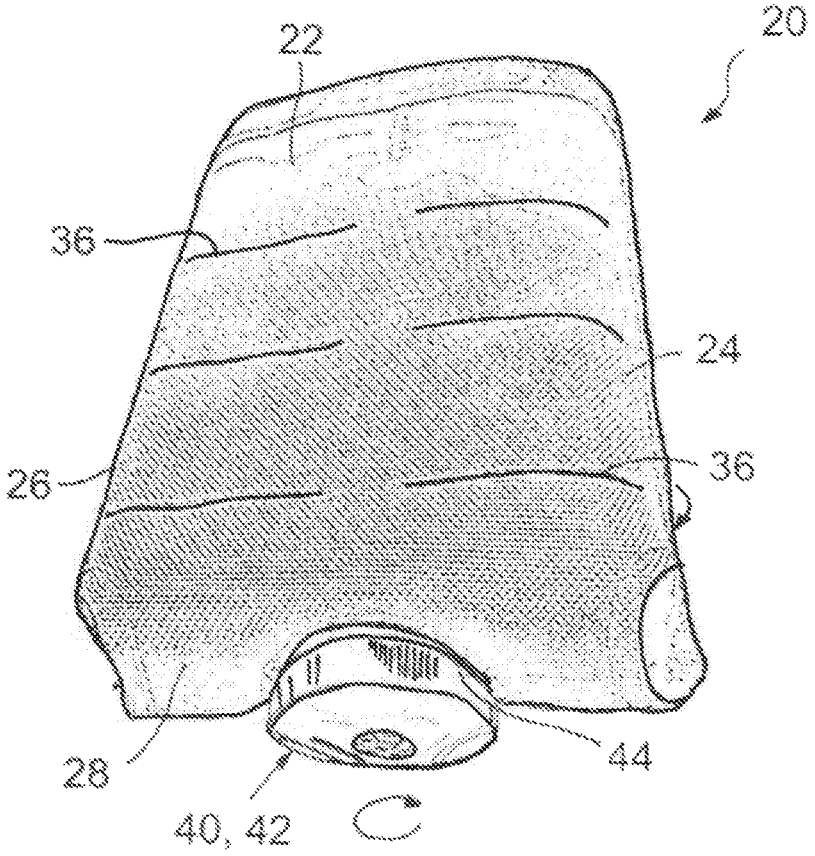
FIG. 2 is a generally bottom perspective view of the pouch of FIG. 1, showing and adjusting knob of a tightening mechanism of the pouch.
Figure 3:
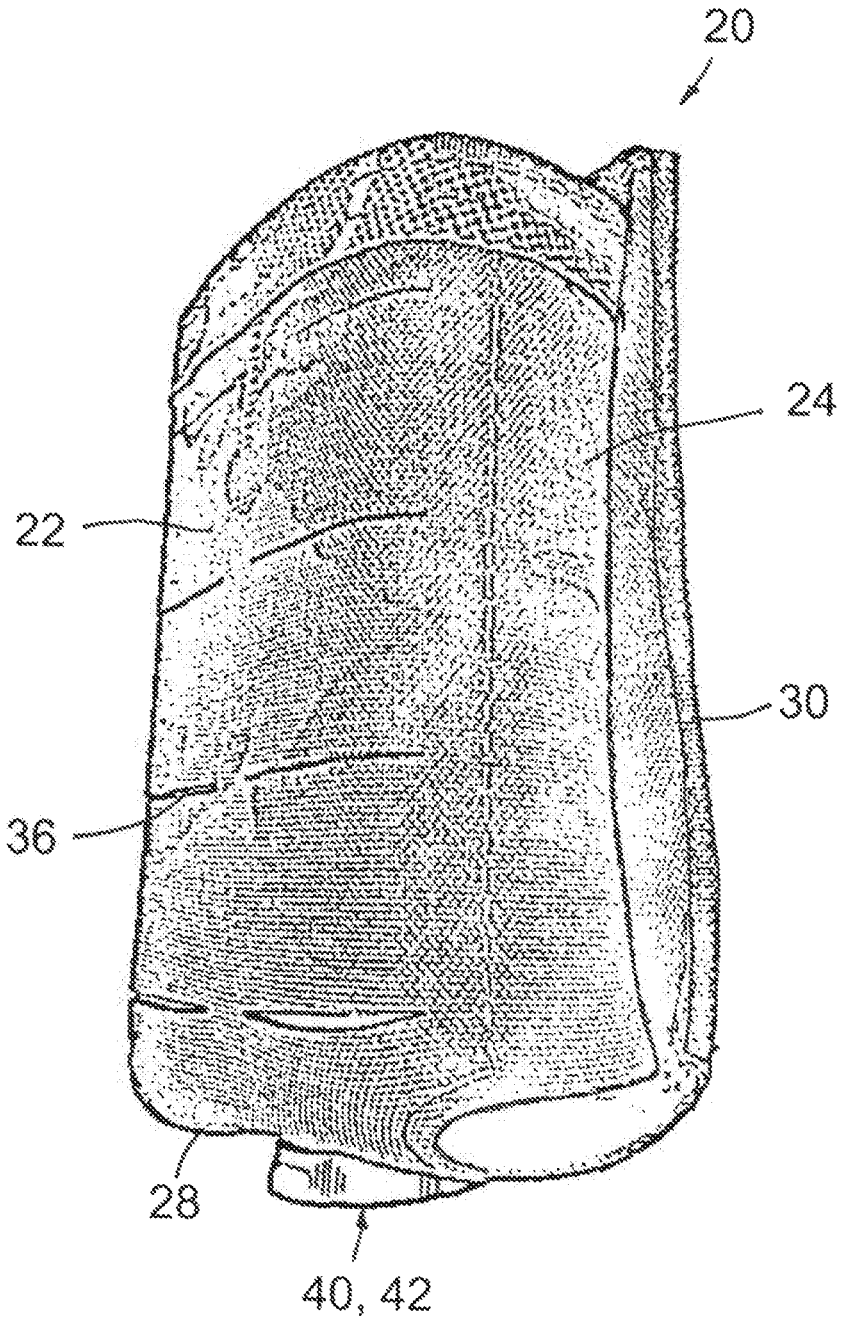
FIG. 3 is a generally side perspective view of the pouch of FIG. 1.
Figure 4:
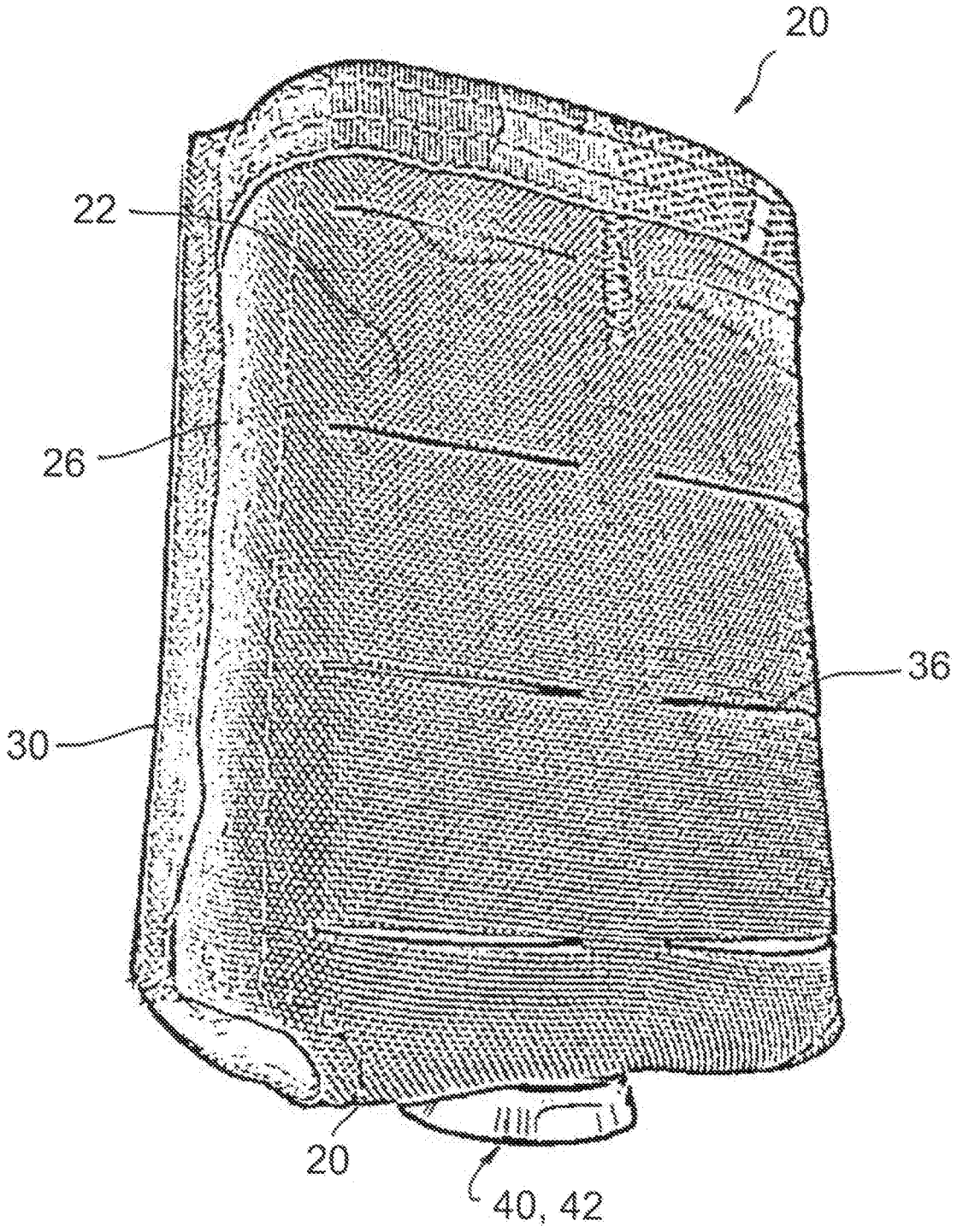
FIG. 4 is a generally front and side perspective view of the pouch, showing MOLLE PALS compatible slits on a front surface of the pouch.
Figure 5:
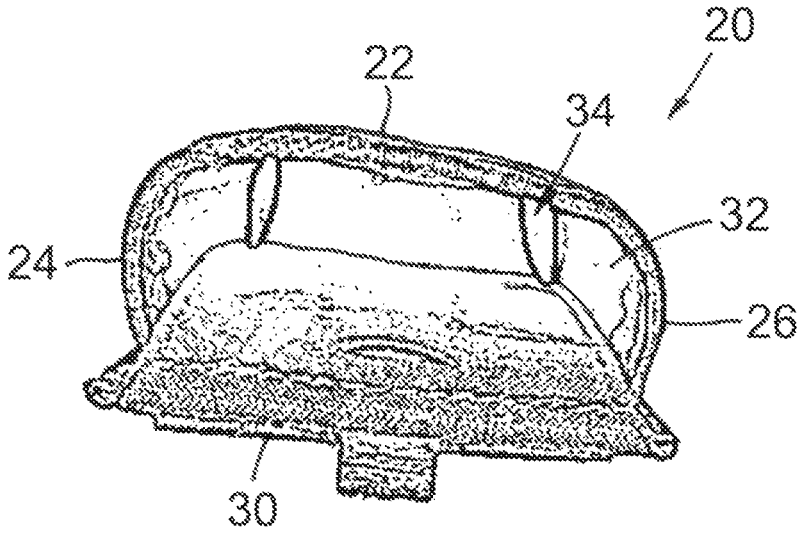
FIG. 5 is a top view of the pouch, showing aspects of an interior cavity thereof.
Figure 6:
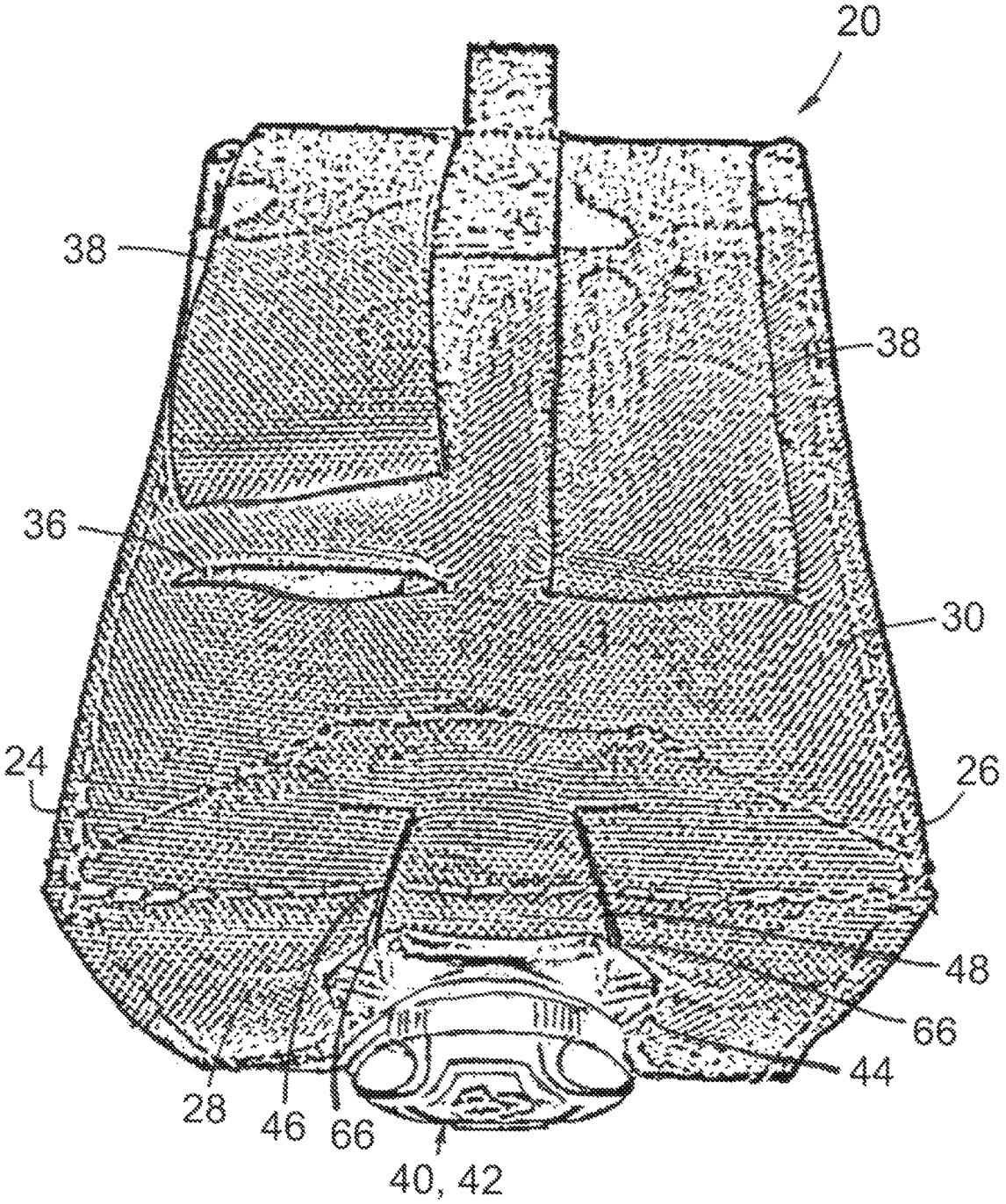
FIG. 6 is a bottom rear perspective view of the pouch, showing and adjusting knob of a tightening mechanism thereof, and MOLLE PALS compatible straps on a rear surface thereof for attaching the pouch to a garment or other object.
Figure 7:
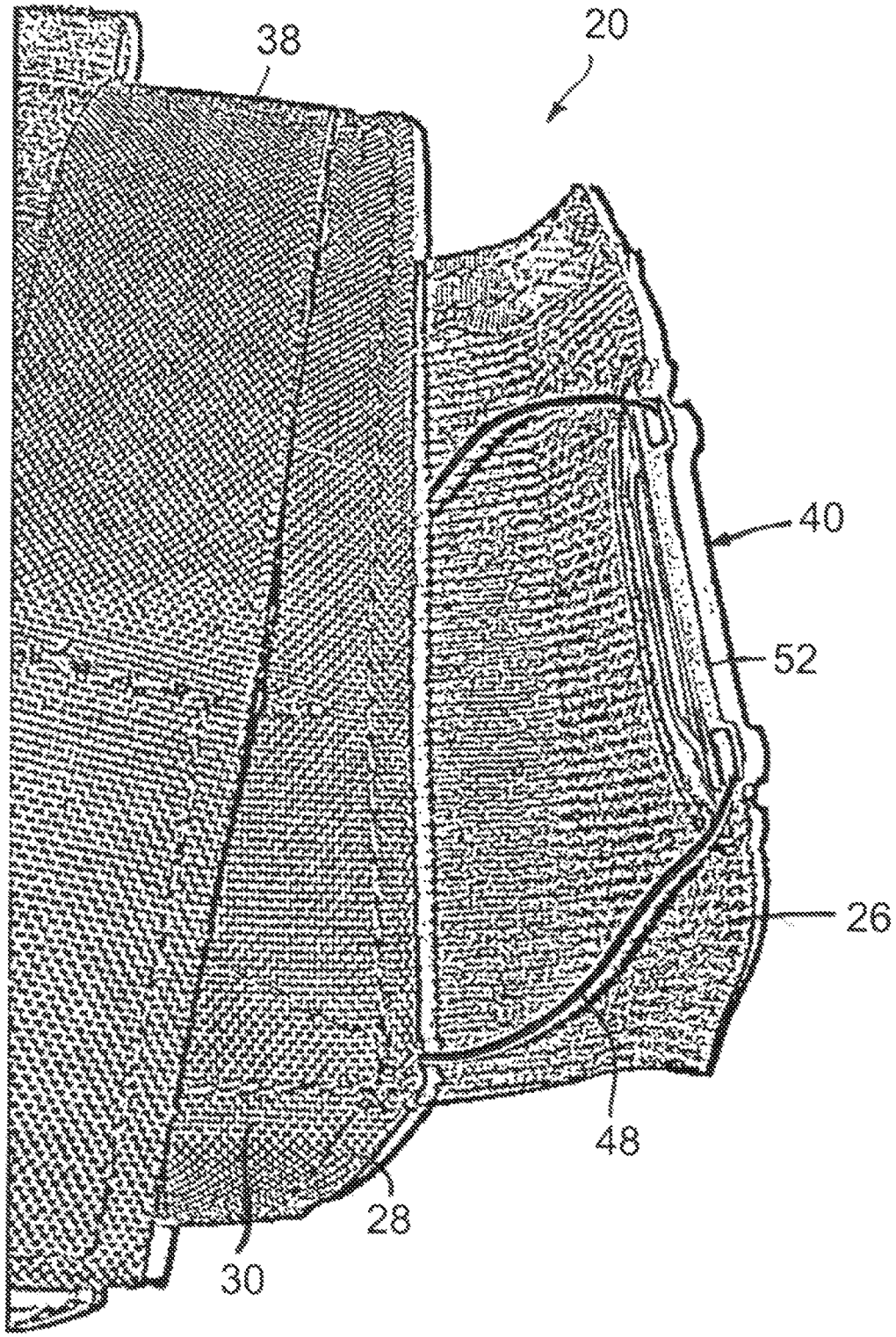
FIG. 7 is a rear view of the pouch, showing a side panel thereof withdrawn from a rear cavity or pocket within a rear panel and an associated lace of the tightening mechanism routed through a guideway attached to the side panel.
Figure 8:
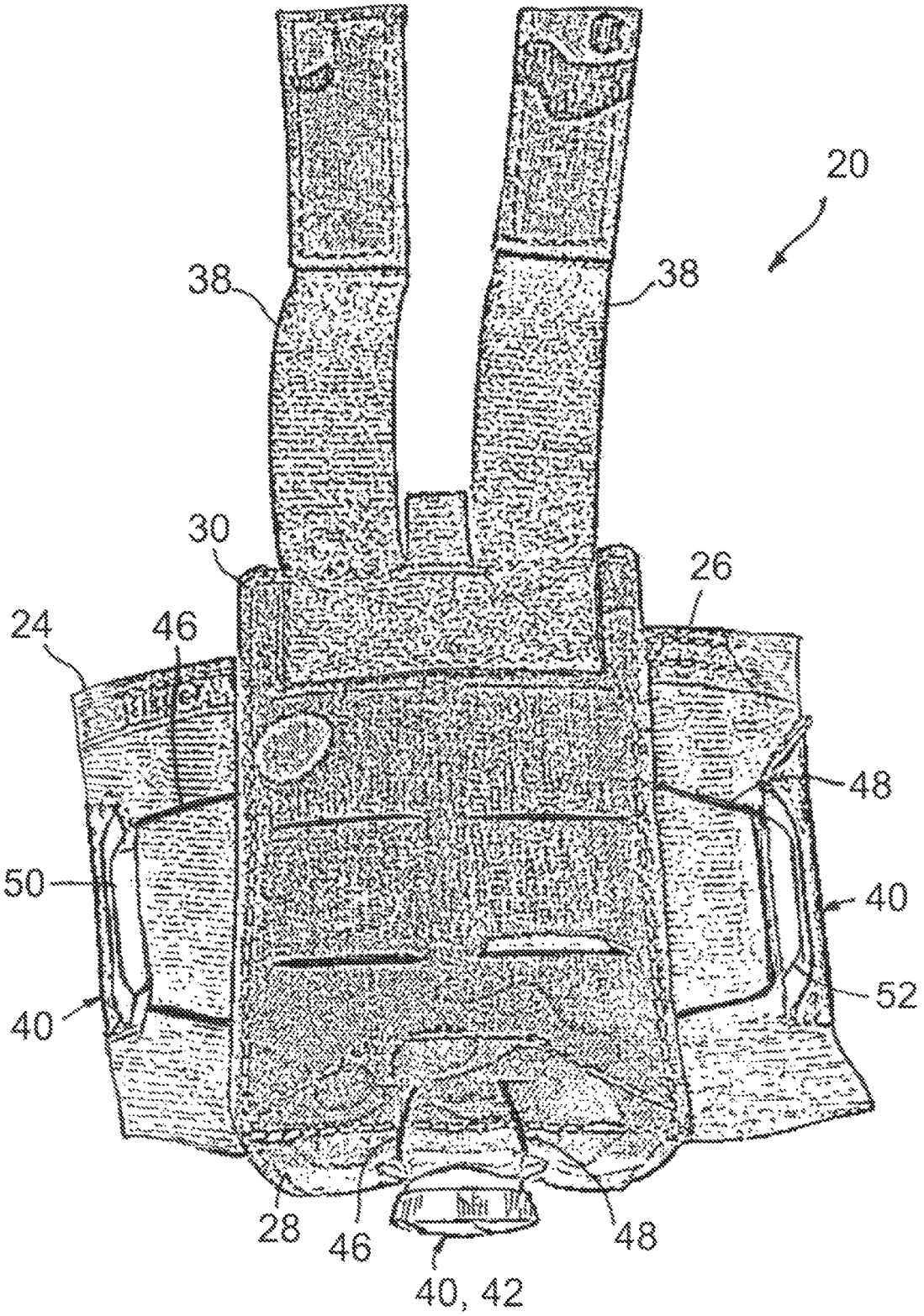
FIG. 8 is another rearview of the pouch, showing the mounting straps, and tongues of two side panels of the pouch removed from the rear cavity or pocket and associated laces and guideways on the tongues of the side panels.
Figure 9:
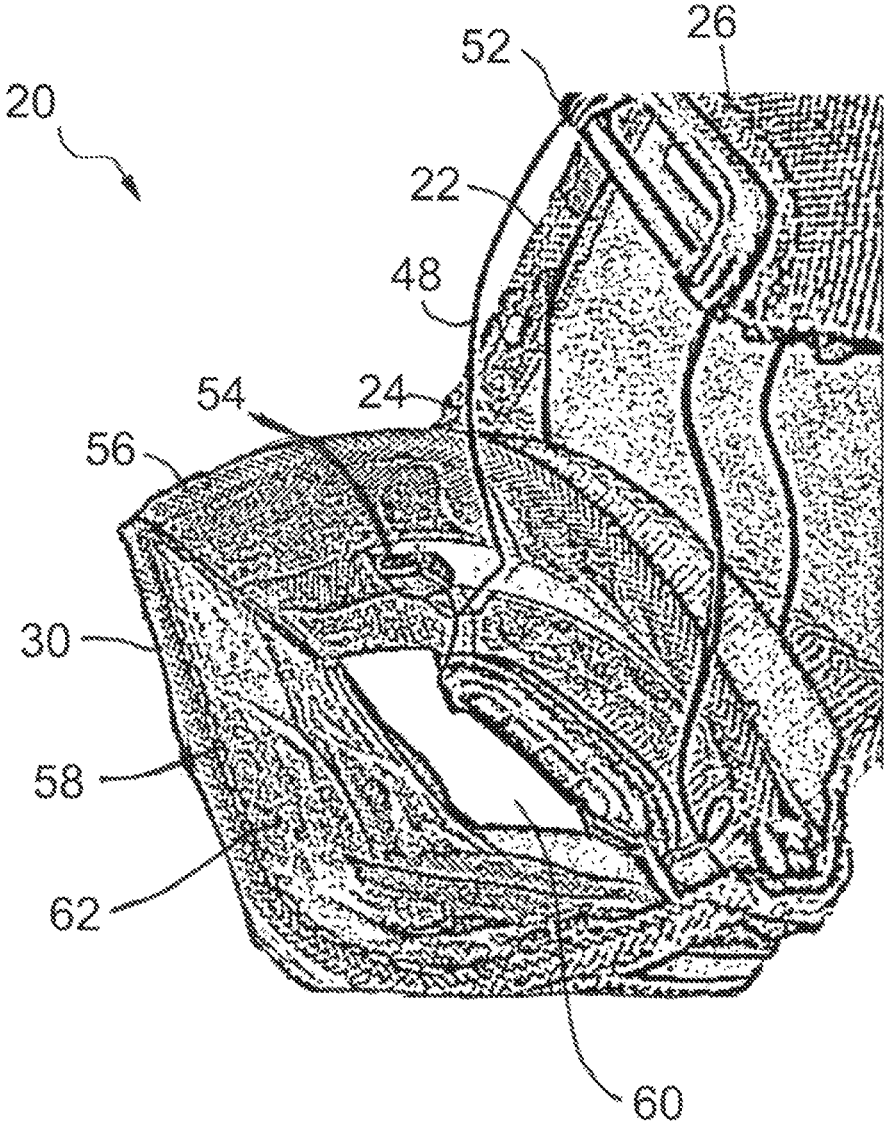
FIG. 9 is a generally side perspective view of the pouch, squeezed to open the rear cavity or pocket to show routing of the laces and an internal guideway.
Figure 10:
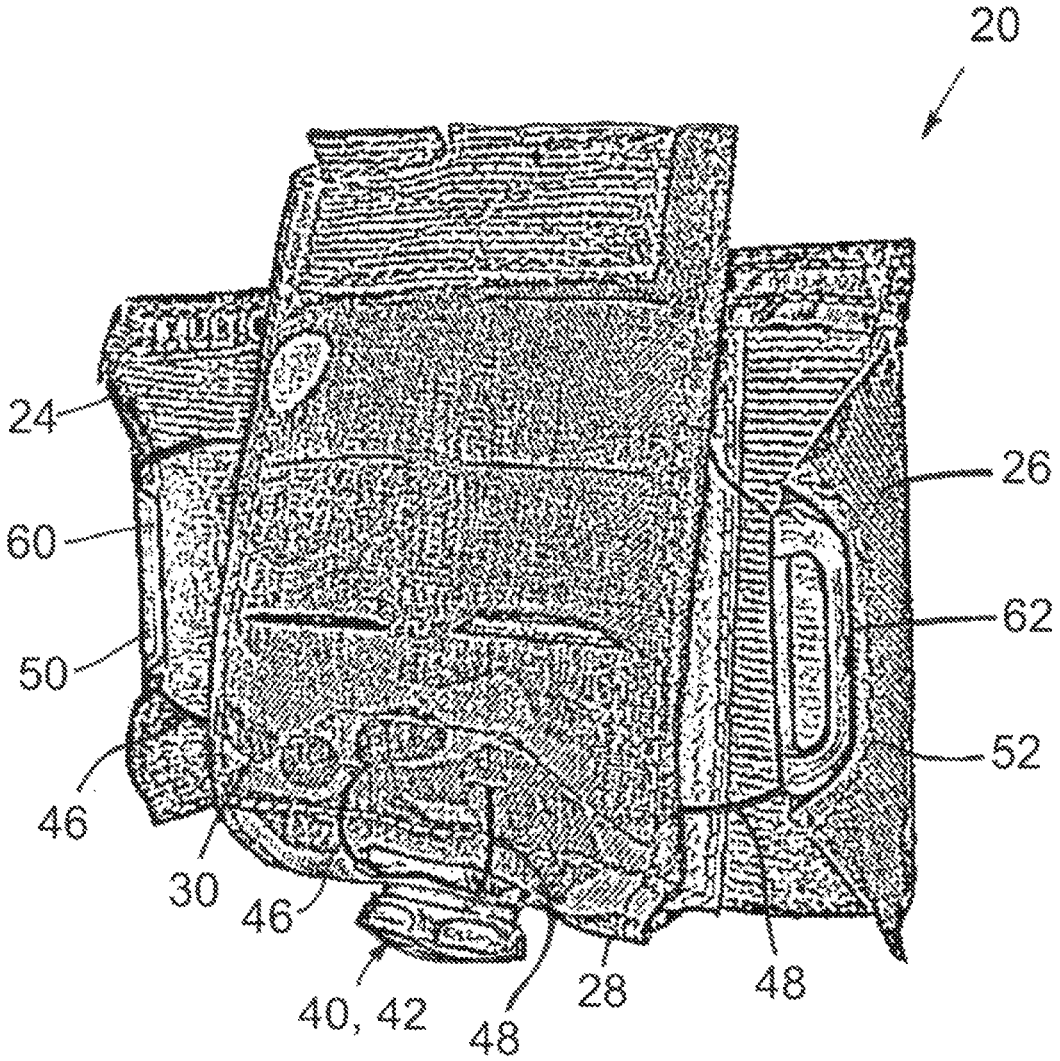
FIG. 10 is a rear side perspective view of the pouch, showing the tongues of the two side panels withdrawn from the rear cavity or pocket, and the associated laces and guideways.

Referring now to the drawings wherein preferred embodiments of the invention are shown, in FIGS. 1-18 a preferred adjustable pouch 20, and a pouch 76 (FIG. 18), generally comprising a front panel 22; a side panel 24; and opposite side panel 26; and a bottom panel 28; that with an interior rear panel 56 associated with an outer rear panel 30 (removed for clarity in FIGS. 16-18), bound and define an interior cavity 32

(FIG. 5) accessible through an opening 34. Panels 22-30 and 56 can be constructed of suitable material, such as but not limited to, a ballistic or non-ballistic nylon, composite or laminate such as, but not limited to an impregnated laminate sold under the Hypalon tradename, rubber or plastics sheet, leather, mesh, or the like, and can be individually stiffened with one or more stiffening layers of a suitable material such as a polymer such as a nylon, polyethylene, or acrylic or metal sheet material, card stock, etc. One or more of panels 22-30 can be integrally formed from a single pattern or sheet of material (see FIG. 12), and/or sewn, adhered or otherwise suitably attached to the other panels. For instance front panel 22 and side panels 24, 26 can be formed of the same sheet of material, folded accordingly. As can be observed, the material can be optionally configured to have a pattern of slits 36 through any of the surfaces of the panels, e.g., for attachment of MOLLE PALS compatible accessories, and for mounting or attaching the pouch 20 as desired. In this latter regard, slits 36 are shown provided on outer rear panel 30 for cooperatively receiving straps 38 in a woven configuration in the well known manner for integrating the pouch with a MOLLE PALS system on a companion garment such as a vest, carrier, web belt, pack, other object, or the like, such as commonly worn by military and law enforcement personnel.

Referring to FIGS. 12-15, the integral front, side, and rear panels 22, 24, 26, 30, and 56, are illustrated, as is a liner panel 80 that is sewn, adhered, or otherwise integrated with front and bottom panels 22 and 28 for reinforcement, and stiffening member 74 that is integrated with interior rear panel 56, e.g. by sewing, adhesion, etc., to stiffen it. Straps 38 are sewn onto the outer rear panel 30 or elsewhere on pouch 20 for use with slits 36 for weaving to a MOLLE PALS system, as desired.

Pouch 20 is exemplary of configurations for carrying a wide variety of articles, such as, but not limited to, one or more ammunition magazines; batteries; grenades; radios; telephones; navigation devices or aids; batteries; cameras; bottles; first aid kits or devices, etc., and the basic configurations and operability of pouch 20 and pouch 76 are suitable to be sized and shaped for receiving and snugging about an armor plate within a range of sizes and shapes. As an example, one size pouch 20 or 76 can be used for holding different armor plates the size and shape of which can vary within the adjustment range of the pouch 20.

Figure 11:
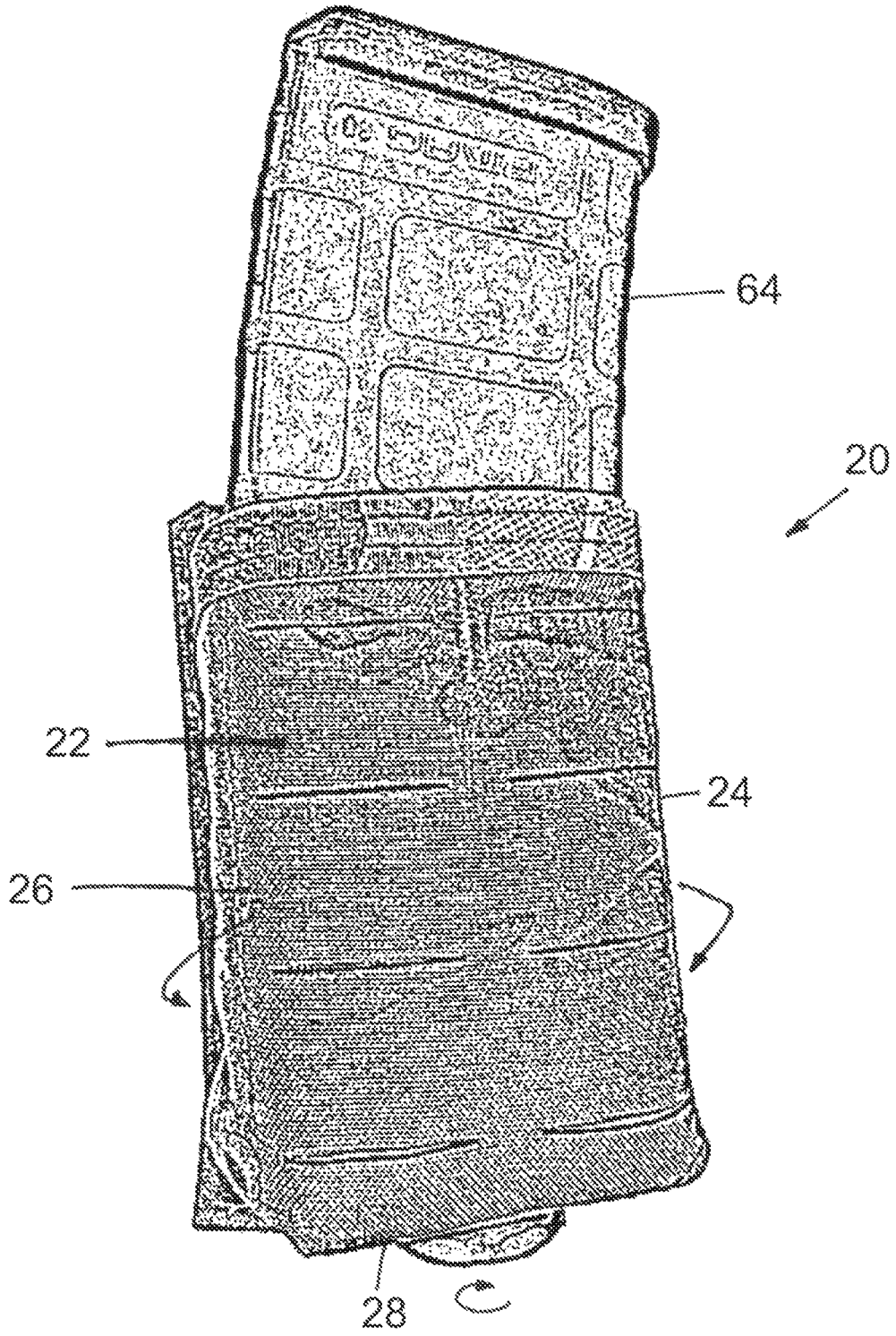
FIG. 11 is a front view of the pouch, showing an ammunition magazine extending from the internal cavity.
Figure 12:
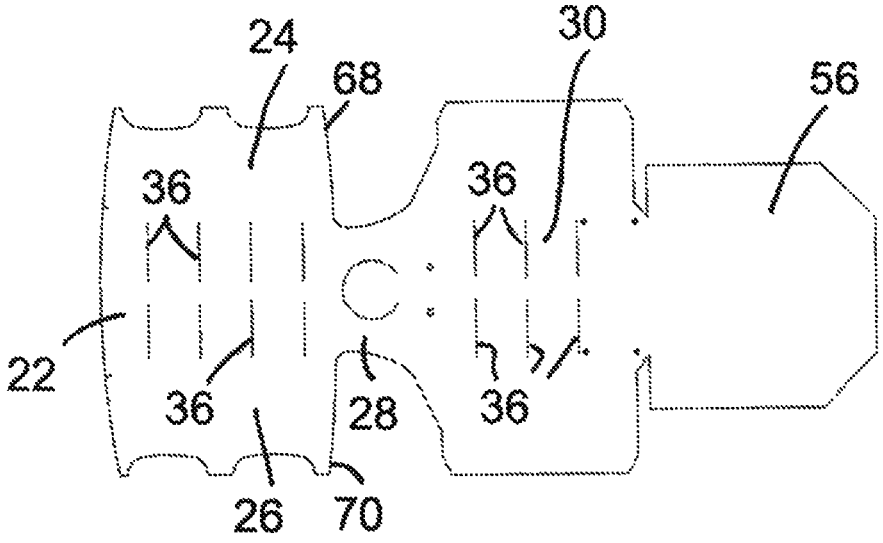
FIG. 12 is a layout view of an integral fabric component for a pouch of the invention, such as, but not limited to, the pouch of FIGS. 1-11.
Figure 13:
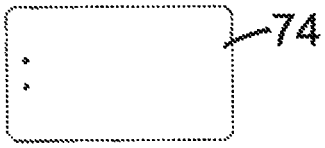
FIG. 13 is a layout view of a stiffening member for use with the pouches of the invention.
Figure 14:
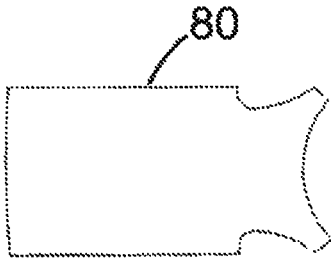
FIG. 14 is a layout view of another fabric component for a pouch of the invention.
Figure 15:
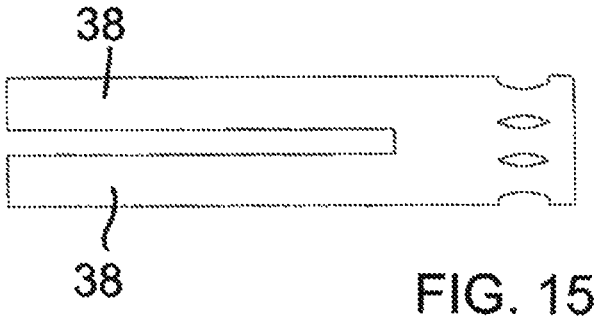
FIG. 15 is a layout view of a fabric component for Molle PALS compatible straps for a pouch of the invention.

Pouch 20 is desirably adjustable such that interior cavity 32 can be enlarged or reduced in sectional extent when viewed from above or below. Here, it should be understood that the directional references front, rear, side, bottom, top, upper and lower, are for reference only herein and thus are not limiting. This adjustability is desirable and convenient to allow use of a single size pouch with articles within a range of sizes, and for tightening or snugging the pouch about an article received therein to a desired extent, such as, but not limited to, so as to securely retain and hold the article under anticipated conditions, such as while running or riding in an open vehicle, swimming, parachuting, or the like, while allowing rapid removal with a single handed action. In this regard, the adjustability can allow a user to tighten the pouch 20 more securely for rugged conditions, then loosen the pouch to a desired extent for operational use, such as the rapid withdrawal of the held article. The pouch can be configured such that an article or articles can be fully received in the interior cavity, or extend outwardly therefrom as illustrated by FIGS. 11, 16, and 17.

Figure 19:
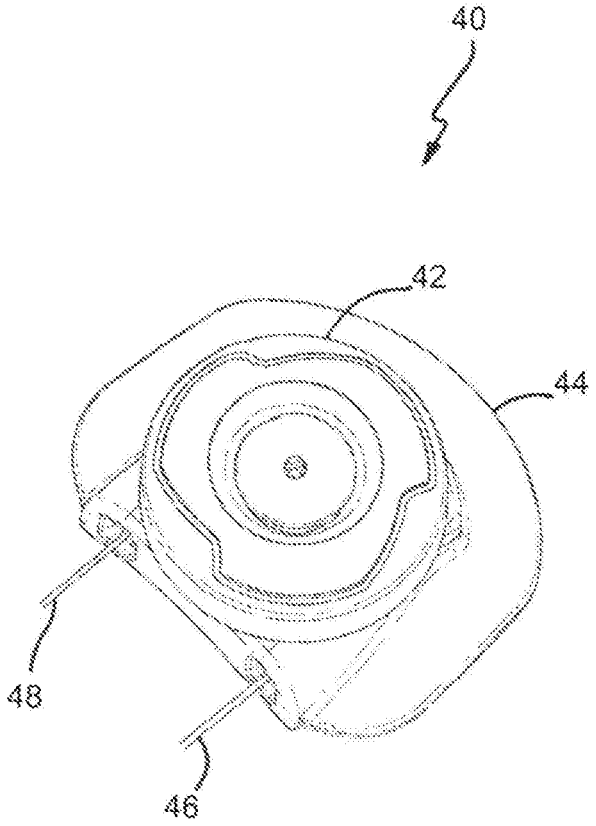
PRIOR ART FIG. 19
FIG. 19 is a perspective view of a representative tightening mechanism that can be used with the invention.

To provide the ability to adjust the size of pouch 20 or pouch 76, it includes a tightening mechanism 40 (see also FIG. 19) comprising a rotatable knob 42 mounted for rotation relative to a base housing 44 that, in this embodiment, is affixed on bottom panel 28 of pouch 20, and on the rear of pouch 76, but can be located anywhere on the pouch as desired or required for a particular application. This is contemplated to include the concealing of mechanism 40 behind any of the associated panels.

Figure 16:
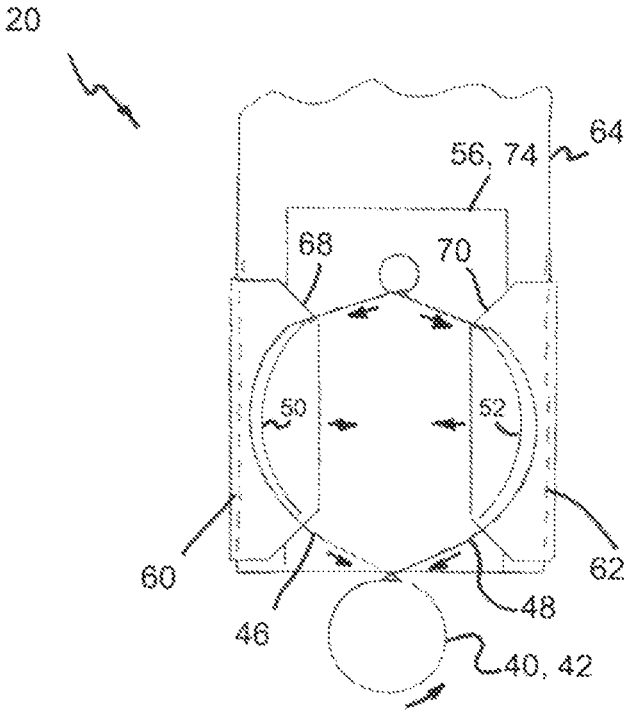
FIG. 16 is a simplified schematic rear view of a pouch of the invention, showing aspects of a panel arrangement and tightening mechanism thereof for tightening panels about an article held in an internal cavity of the pouch, showing operational aspects thereof.
Figure 16A:
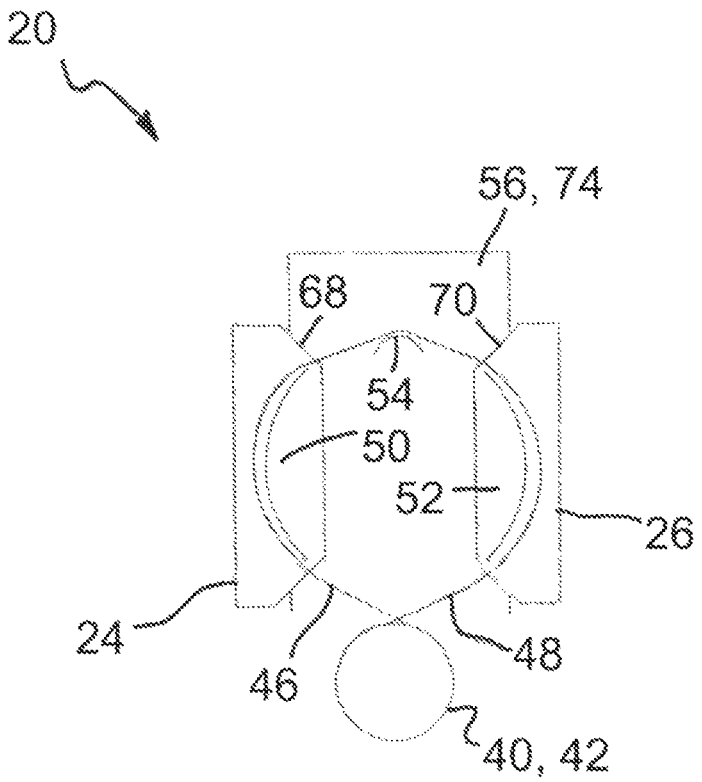
FIG. 16A is a simplified schematic rear view of the pouch of FIG. 16, showing an alternative lace routing.
Figure 17:
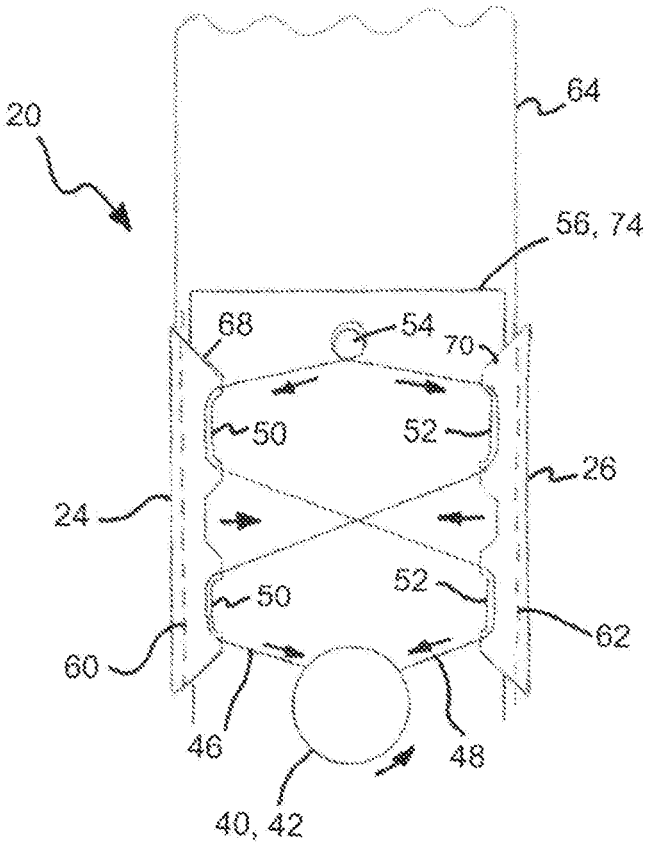
FIG. 17 is a simplified schematic rear view of another pouch of the invention, showing aspects of a panel arrangement and tightening mechanism thereof for tightening panels about an article held in an internal cavity of the pouch, showing operational aspects thereof.
Figure 17A:
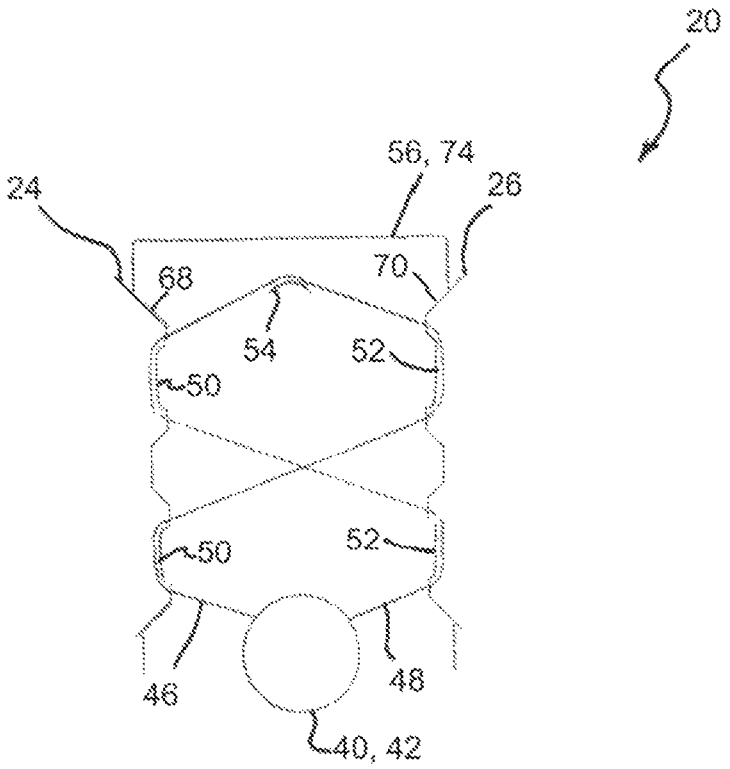
FIG. 17A is a simplified schematic rear view of the pouch of FIG. 17, showing an alternative lace routing.
Figure 18:
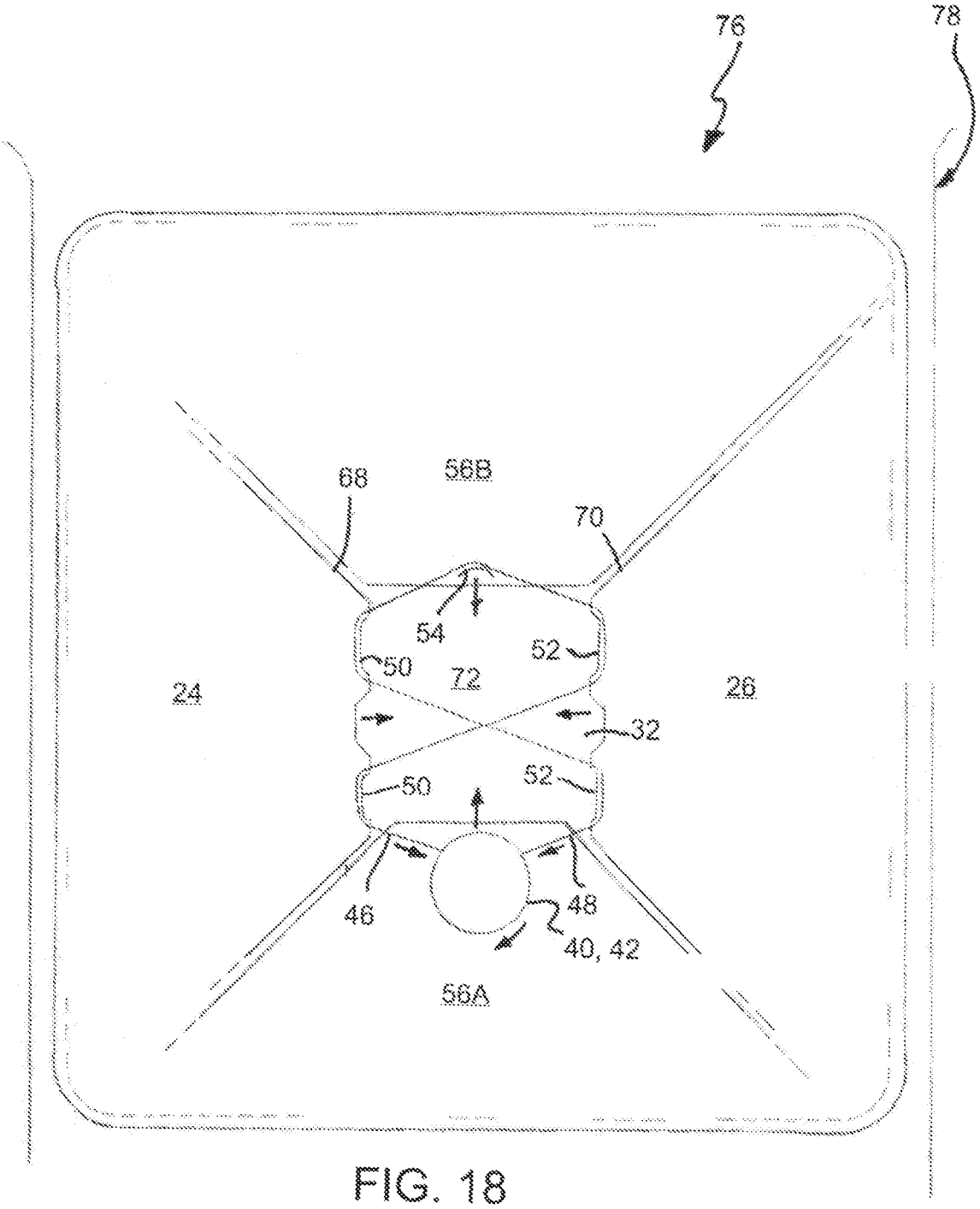
FIG. 18 is a simple side schematic rear view of another pouch of the invention, shown holding an article which is an armor plate.

As best shown in FIGS. 16-18, mechanism 40 includes a pair of laces 46 and 48 (can be ends of a single wire, string, or filament, or separate wires, strings, filaments) that are routed within pouch 20 about side guideways 50 and 52 mounted to opposite edges of tongues 68 and 70 of side panels 24 and 26, respectively, to couple the laces 46, 48 to those panels to enable the laces 46, 48 to pull or move the panels 24, 26, as shown by associated arrows, while allowing sliding movement of the laces relative thereto required for the tightening action, as the knob 42 is rotated as shown by the associated arrows in FIGS. 16-18. On pouch 20, an additional upper guideway 54 is mounted on a surface of interior rear panel 56 that with outer rear panel 30 bounds and defines a rear cavity or pocket 58 having opposite side openings 60, and 62, adjacent to side panels 24, 26, respectively. Guideway 54 is preferably located at the upper end region of panel 56, so as to be opposite the bottom mounted base housing 44 and panel 56 is preferably stiffened, as a non-limiting example, by a stiffening member 74 (see FIGS. 13, 16, 16A, 17, 17A), which, as a non-limiting example can comprise a sheet of polymer or the like, so that guideway 54 is not displaced significantly toward housing 44 as the laces are tightened if that is desired.

Alternatively, the interior rear panel 56 alone or with outer rear panel 30 can be constructed and fashioned so as to be controllably flexed to a controlled extent by the tightening of mechanism 40 so that the upper region of the rear panel 56 will bear against and snug an article such as magazine 64 when located in cavity 32. It should be recognized thus that the effects the sideward movement of side panels 24, 26 into and toward the center region of the rear cavity or pocket 58 is preferably the main manner of snugging and holding an article located in cavity 32, but for instance, where extra security is desired, the optional controlled flexibility of panel 56 can be employed to snug against the upper region of the article in the vicinity of opening 34, if desired. This controlled flexibility can be achieved in any desired manner such as by scoring a line across the stiffening member 74 or otherwise appropriately weakening it in an appropriate location relative to guideway 54.

Mechanism 40 can be a commercially available tightening mechanism such as disclosed in Burns et al., U.S. Patent Publication No. 2013/0269219, Goodman et al. U.S. Pat. No. 9,408,437 B2 issued Aug. 9, 2016, and Soderberg et al., U.S. Pat. No. 9,138,030 B2 issued Sep. 22, 2015, all incorporated herein in their entireties, and commercially available from Boa Technologies.

This rear cavity or pocket is desirable and of substantial utility, as it provides a space for variably receiving free ends or tongues 68, 70, respectively, of side panels 24 and 26 through the side openings 60, 62, respectively, for relative movement of the side panels within the rear cavity or pocket relative to rear panels 30 and 56 (see associated arrows in FIGS. 16 and 17) for adjusting or tightening the pouch to desired extents. In this regard, it should be apparent that the tightening of mechanism 40 will impart tension in laces 46, 48 and pull them as shown by the associated arrows to impart forces to side panels 24, 26 in a direction toward the center of rear pocket or cavity 58 and thus toward each other to effect the reduction in the sectional extent, here, sideward, of the interior cavity 32 if empty, or the snugging of side panels 24, 26 against an article contained in cavity 32, such as magazine 64.

Rear cavity or pocket 58 is also advantageously employed to substantially completely internally route laces 46, 48 so as to be protected from the environment and also isolated from interior cavity 32 for the above explained advantages. Here, laces 46 and 48 are routed about side guideways 50 and 52 on tongues 68 and 70, respectively, and about guideway 54 (see FIG. 16), and cross one time in that vicinity, although other patterns can be used, such as a criss-cross pattern similar to those commonly used for footwear (see FIGS. 17, 17A, 18), all within pocket 58. In pocket 20 the laces 46, 48 extend externally for a short distance to enter lace ports on base housing 44, but that is not a necessity and they and the lace ports 66 can be completely internalized, if desired. Here also, by substantially, what is meant is that at least about 90 percent of the lengths of laces 4, 48 are covered.

Here it is also be mentioned that the surface or surfaces of interior rear panel 56 and/or outer rear panel 30 facing rear pocket or cavity 58 can optionally comprise a material having a lower coefficient of friction than other surfaces of the panels, to provide ease and silence of movement of laces 46, 48 and guideways 52, 54 thereover. In this regard, it is contemplated that a pouch such as pouch 20 will be tightly attached to a supporting structure such as a load bearing platform of a garment such as an armor carrier or tactical vest, cummerbund, or the like, and the pouch 20 can carry relatively heavy objects such as an ammunition magazine or magazines 64, so that substantial tension may be applied to laces 46 and 48 and such that they can have a tendency to cut material that they cross. Employing a low coefficient of friction yet stiff surface in contact with the laces such as here has utility for preventing wear and potential failure under contemplated loading conditions.

In operation, by rotation of knob 42 as illustrated variously and particularly in FIGS. 16 and 17, forces are applied by laces 46, 48 against side panels 24, 26 to simultaneously drawn them through the respective side openings 60, 62 (by the drawing of laces 46, 48 toward tightening mechanism 40, as shown by the associated arrows), into pocket 58, so that crimping creasing, and other problems are avoided and the laces 46, 48 are substantially completely protected from the environment and from contact with the article or articles held in the pouch. It can be understood that rotation of the knob 42 as illustrated will translate into the exertion of the forces against the side panels to tighten or snug front panel 22 also about an article or articles held in the cavity, such as the ammunition magazine 64 shown. To reduce the tightness, knob 42 can be pulled away from base housing 44 to release the laces 46, 48 and the applied forces so that the side panels can be easily and conveniently pulled to a desired extent from pocket 58.

Here, it should be noted that knob 42 can be located at a variety of locations, including on any of the panels of the pouch 20, as desired or required for a particular application. It should also be noted that knob 42 can be internalized, such as by being located within pocket or cavity 58 so as to be protected also.

Still further, it should be understood that the invention can be scaled for a variety of applications, such as for holding larger articles such as large armor plates 72 that are several times larger than the magazine 64 shown.

In this regard, FIG. 18 shows pouch 76 that can be incorporated into a garment 78 which can be for instance an armor carrier, tactical vest, cummerbund, neck protector, groin protector or the like, and receive and hold armor plate 72 in interior cavity 32 bound and defined by a front panel (covered by the armor plate in this view), side panels 24, 26, and upper and lower rear panels 56A and 56B respectively. A panel or edge of a panel or between two panels, can include a suitable slot or opening that enables inserting plate 72 into cavity 32, and removing it, and which can be closed by a suitable closure device such as a hook and loop fastening system, flap, zipper, or the like, with the interior extent or dimensions of the cavity being adjustable by the tightening (or loosening) of tightening mechanism 40 to accommodate the particular plate selected, and as shown by the associated arrows. Here it can be observed that a split upper and lower rear panel 56A, 56B configuration can be used, or a single rear panel 56, as desired or required. Here also it can be seen that in this configuration illustrated, the employment of guideway 54 on a movable portion of rear panel will effect the reduction or enlargement of the dimension between rear panels 56A, 56B, for adjusting that extent of cavity 32. This is optional and this dimension can be fixed if desired by employing a fixed rear panel 56 as described above. Thus, it should be understood that it is contemplated that an additional direction or directions of adjustability can be provided, for instance by allowing some bending or flexibility of interior rear panel 56 so as to be pullable to some extent toward base housing 44 of the tightening mechanism 40, that a multiple piece rear panel 56A, 56B arrangement can be used, and that multiple tightening mechanisms can be used, as desired or required for an application. In this latter regard, separate tightening mechanisms 40 could be used for tightening the pouch in different directions. Further, it should be noted that the role of the outer rear panel 30 (not shown) can be served by an element of the associated garment 78, such as by locating pouch 76 within an outer pouch or load bearing platform such as utilized on a variety of armor carriers and tactical vests.

In light of all the foregoing, it should thus be apparent to those skilled in the art that there has been shown and described a novel adjustable pouch with lace tightening mechanism having closed protected laces. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. An adjustable pouch for holding an article, comprising: an arrangement of panels defining an interior cavity for receiving the article; a tightening mechanism coupled to the arrangement, the tightening mechanism comprising a rotatable knob, wherein rotation of the knob in a tightening direction tightens at least one lace to pull at least one of the panels of the arrangement of the panels toward another of the panels thereof to tighten the arrangement of panels about the article when received in the interior cavity; and the arrangement of panels including overlaying panels bounding at least one cavity separate from the interior cavity, containing and concealing the at least one lace while isolating the at least one lace from the article;

wherein the at least one of the panels comprises two panels that each comprise a tongue disposed in opposing relation within the at least one cavity separate from the interior cavity such that the tongues will be pulled together when the at least one lace is tightened to pull the two of the panels to tighten the arrangement of panels about the article when received in the interior cavity.

2. The adjustable pouch of claim 1, wherein at least one of the overlaying panels comprises a stiffening member that is stiffer than the at least one of the panels.

3. The adjustable pouch of claim 1, wherein the arrangement of panels defines an opening connected to the interior cavity and through which the article is receivable into the interior cavity.

4. The adjustable pouch of claim 3, wherein the at least one lace is coupled to one of the overlaying panels in a manner to pull the one of the overlaying panels toward the opening when the at least one lace is tightened.

5. The adjustable pouch of claim 1, wherein the article comprises at least one ammunition magazine having a predetermined overall size and shape and the interior cavity has a size and shape that matches at least a portion of the overall size and shape of the at least one ammunition magazine.

6. The adjustable pouch of claim 1, wherein the article comprises an armor plate having a predetermined overall size and shape and the interior cavity has a size and shape that matches at least a portion of the overall size and shape of the armor plate so as to be capable of receiving at least the portion of the armor plate.

7. The adjustable pouch of claim 1, wherein an outer one of the overlaying panels comprises at least one element compatible with a MOLLE PALS attachment system to enable attaching the pouch to a MOLLE PALS attachment system on a garment or object.

8. The adjustable pouch of claim 1, wherein at least one of the overlaying panels bounding the at least one cavity separate from the interior cavity is stiffer than others of the panels of the arrangement bounding the interior cavity.

9. The adjustable pouch of claim 8, wherein the at least one of the overlaying panels bounding the at least one cavity separate from the interior cavity comprises a surface facing the at least one cavity separate from the interior cavity, having a coefficient of friction less than a coefficient of surfaces of the panels facing the interior cavity.

10. The adjustable pouch of claim 1, wherein the panels of the arrangement of panels defining the interior cavity are integrally attached.

11. The adjustable pouch of claim 1, wherein at least some of the panels of the arrangement of panels defining an interior cavity are joined together by sewing, fusion, an adhesive, or fasteners.

12. An adjustable pouch for holding an article, comprising:

an arrangement of panels bounding an interior cavity, comprising a front panel, a first side panel connected to the front panel along a first side periphery thereof, a second side panel connected to the front panel along a second side periphery thereof opposite the first side periphery, a bottom panel connected to the front panel along a bottom periphery thereof extending between the first side periphery and the second side periphery, an interior rear panel connected along a bottom periphery thereof to the bottom panel;

the front panel, the first side panel, the second side panel, and the interior rear panel bounding an opening connected to the interior cavity;

an outer rear panel overlaying at least a portion of the inner rear panel defining a rear cavity therebetween separated from the interior cavity by the interior rear panel, the outer rear panel and the interior rear panel bounding a first side opening through which a tongue portion of the first side panel extends into the rear cavity, and a second side opening opposite the first side opening and through which a tongue portion of the second side panel extends into the rear cavity; and a tightening mechanism mounted on the pouch and having at least one lace coupled to the tongue portion of at least one of the first side panel and the tongue portion of the second side panel in a manner such that tensioning of the at least one lace by the tensioning device will exert a force against the at least one of the first side panel and the second side panel to pull the at least one of the first side panel and the second side panel toward the rear cavity to reduce a dimension of the interior cavity or exert a force about an article located therein to hold the article.

13. The adjustable pouch of claim 12, wherein at least one of the outer rear panel and the inner rear panel comprises a stiffening member that is stiffer than others of the arrangement of panels bounding the interior cavity.

14. The adjustable pouch of claim 13, wherein the stiffening member has a surface facing the rear cavity that has a coefficient of friction less than a coefficient of friction of surfaces of the panels of the arrangement of panels bounding the interior cavity.

15. The adjustable pouch of claim 13, wherein the at least one lace is coupled to the stiffening member.

16. The adjustable pouch of claim 15, wherein the inner rear panel comprises the stiffening member.

17. The adjustable pouch of claim 13 wherein the stiffening member is configured and has a sufficient stiffness to resist bending when the force is exerted against the at least one of the first side panel and the second side panel.

18. The adjustable pouch of claim 13 wherein the stiffening member is configured to bend toward the article located in the interior cavity to exert a portion of the force exerted thereagainst a force about an article located therein to hold the article a when the force is exerted against the at least one of the first side panel and the second side panel.

19. The adjustable pouch of claim 12, wherein the at least one lace is coupled to the tongue portion of the first side panel and to the tongue portion of the second side panel.

20. The adjustable pouch of claim 12, wherein at least the outer rear panel comprises at least one element compatible with a MOLLE PALS attachment system to enable attaching the pouch to the MOLLE PALS attachment system.

21. The adjustable pouch of claim 12, wherein the article comprises at least one ammunition magazine having a predetermined overall size and shape and the interior cavity has a size and shape that matches at least a portion of the overall size and shape of the at least one ammunition magazine.

22. The adjustable pouch of claim 12, wherein the article comprises an armor plate having a predetermined overall size and shape and the interior cavity has a size and shape that matches at least a portion of the overall size and shape of the armor plate so as to be capable of receiving at least the portion of the armor plate.

23. The adjustable pouch of claim 12, wherein the panels of the arrangement of panels defining the interior cavity are integrally attached.

24. The adjustable pouch of claim 12, wherein at least some of the panels of the arrangement of panels defining the interior cavity are joined together by sewing, fusion, an adhesive, or fasteners.

* * * * *